United States Patent [19]

Intengan

[11] 4,318,189

[45] Mar. 9, 1982

[54] SIMULATED KNOTTED NECKTIE

[76] Inventor: Franklin S. Intengan, 666 W. 81st St., Apt. W-122, Hialeah, Fla. 33014

[21] Appl. No.: 146,638

[22] Filed: May 5, 1980

[51] Int. Cl.[3] ..... A41D 25/02

[52] U.S. Cl. ..... 2/144; 2/150; 2/153

[58] Field of Search ..... 2/149, 150, 144, 145, 2/148, 152 R, 152 A, 153

[56] References Cited

U.S. PATENT DOCUMENTS

| | | | |
|---|---|---|---|
| 1,581,193 | 4/1926 | Gilbert | 2/153 X |
| 2,530,975 | 11/1950 | Lewis | 2/150 |
| 3,146,467 | 9/1964 | Levko | 2/153 |
| 4,173,792 | 11/1979 | Intengan | 2/150 X |

FOREIGN PATENT DOCUMENTS

| | | | |
|---|---|---|---|
| 144168 | 7/1935 | Austria | 2/150 |
| 254694 | 8/1927 | Italy | 2/150 |

*Primary Examiner*—Louis Rimrodt
*Attorney, Agent, or Firm*—John Cyril Malloy

[57] ABSTRACT

A simulatd knotted necktie composed of a hollow knot shaped body having a main front face, a rear face with a first hole centrally arranged and having a lower lip, a bottom face with a hole and a top surface with the side walls of the body each having an opening adjacent the top face and a necktie length with a display tail overlaying and jacketing the main body face, a rear tail and a neck loop length between the tails with the neck loop length extending from said body openings and the rear tail or hidden tail extending from the bottom hole and the display tail extending from the rear face hole with the rear face of the display tail overlaying the main face of the body and a keeper to hold the display tail in snug jacketing relation of the main face of the body to simulate a knot of a necktie of predetermined style.

4 Claims, 14 Drawing Figures

SIMULATED KNOTTED NECKTIE

FIELD OF THE INVENTION

This invention relates to a simulated knotted necktie.

BACKGROUND OF THE INVENTION

In the past there have been numerous types of simulated knotted neckties, such as that found and described in my formerly granted U.S. Pat. No. 4,173,792.

OBJECTS OF THE INVENTION

It is an overall object of this invention to provide a simulated knotted necktie which is composed of a hollow body from which a necktie extends and wherein the shape and configuration of the body dictates the three dimensional form of the necktie knot simulation with the display tail of the necktie snugly jacketing the body and extending away from it and being maintained in the knot simulation attitude by means of a hooked keeper.

It is a general object of this invention to provide an improved type of neckwear which is composed of a minimum number of parts, easily installed, and which appears neat and stylish in use.

In accordance with these and other objects which will become apparent hereinafter, the instant invention will now be described on reference to the accompanying drawings in which:

DESCRIPTION OF THE PREFERRED EMBODIMENT

Figure 1:
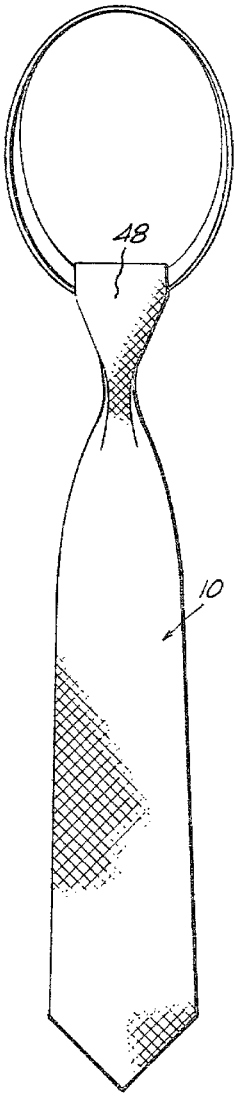
FIG. 1 is a front elevation view of the instant invention in an assembled condition.
Figure 2:
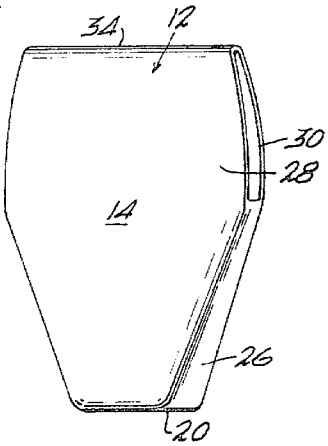
FIG. 2 is a perspective view of the hollow body which dictates the three dimensional form of the necktie knot simulation.

Referring to FIG. 1, a necktie 10 is illustrated. It is formed using a body 12, see FIG. 2, of a generally inverted triangular shape and about which the necktie is manipulated according to the steps as seen in FIGS. 7 through 10. After the necktie 10 is wrapped about the triangular shaped body, see FIG. 1, it is secured to the body by a keeper means of which there may be various alternatives as will be described more fully hereinafter.

Figure 3:
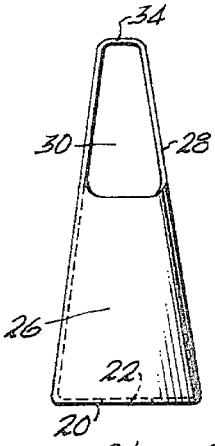
FIG. 3 is a right side elevation view of the body shown in FIG. 2.
Figure 4:
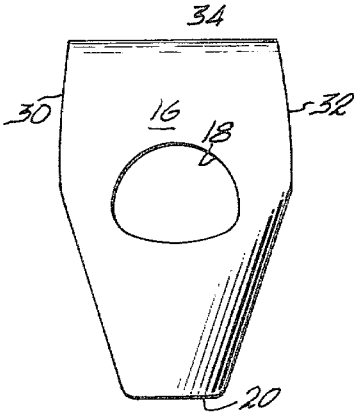
FIG. 4 is a rear view of the body shown in FIG. 2.
Figure 5:
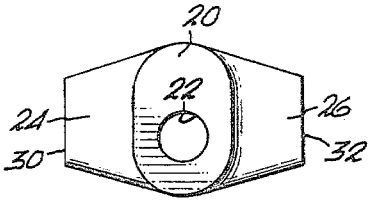
FIG. 5 is a bottom view of the body shown in FIG. 2.

It will be helpful to consider first the body 12, best seen in FIGS. 2 through 5. The shape of the body dictates the shape of the simulated necktie; and it may be of molded, hollow, rigid plastic elastomeric or metallic material. The hollow body 12, which is symmetrical with respect to a vertical center plane has a front face 14, a rear face 16, with a first hole 18 centrally arranged through it, a bottom face 20 with a somewhat smaller second hole 22 through it, and opposite side walls 24 and 26, see FIG. 5, which diverge with respect to one another upwardly from the bottom face to an upper shoulder zone 28 of the body at which each side wall has an opening, see at 30 and 32, adjacent the top face 34. Preferably, the front and rear faces diverge outwardly with respect to one another as best seen in FIG. 3 from their respective junctures with the top face 34. The use of the body will now be described.

Figure 10:
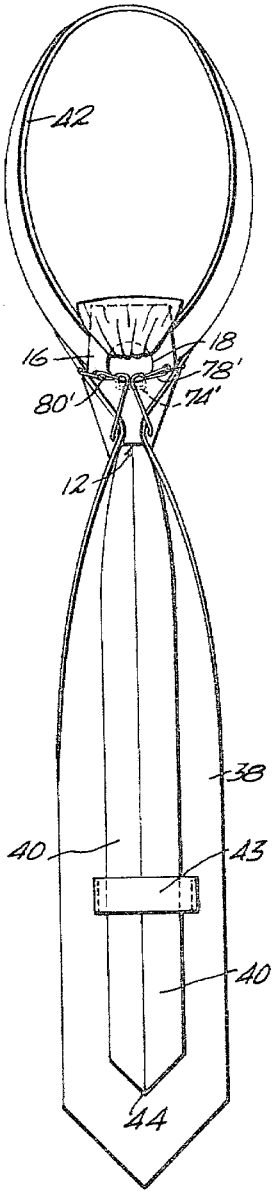
FIG. 10 is a rear elevaton view of the assembled necktie length and body and illustrating the keeper in one alternative in position with the display face snugly jacketing the body and extending therefrom.

For purposes of description, the necktie ten may be considered to be composed of (a) a display tail 36 with a display face and an opposite or rear face 38, (b) a hidden or rear tail 40, "hidden" because it is not ordinarily seen in use, and (c) an intermediate portion 42 to encircle the neck of a user. A loop 43 to hold the rear tail to the display tail may be provided, as shown in FIG. 10.

Referring to FIGS. 7 through 10, the tip 44 of the hidden or short rear tail 40 is inserted through the hole 18 in the rear face of the body and led out of the opening 30; and a loop 46 is formed when the tip 44 is inserted back into the body, through the shoulder opening 32, and withdrawn from the body through the bottom hole 22. The knot zone 48 of the necktie which overlays the front face will generally conform to the configuration of the body, see FIG. 1, and means are provided to keep the knot zone in a desired snugly jacketing relation over the front face of the body, as will now be described, first on reference to FIGS. 11 and 12.

Figure 11:
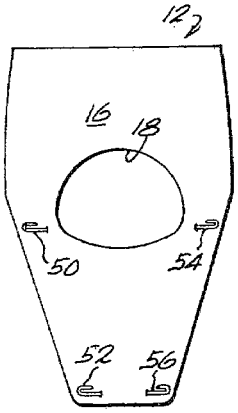
FIG. 11 is an alternative embodiment of a keeper.
Figure 12:
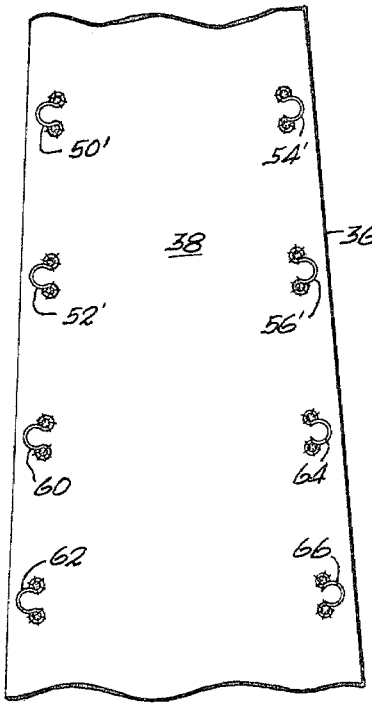
FIG. 12 is of a necktie with eyes along a portion of the length thereof for hooked-up engagement with the hooks in the alternative embodiment of FIG. 11.

The keep means in the embodiment of FIGS. 11 and 12 is composed of hooks 50, 52, 54 and 56 which are suitably secured to the rear face of the body and which are sharp enough for hooked-up engagement directly with the periphery of the tie to impale it. The hooks are arranged in a pattern and are spaced vertically from one another a predetermined distance. As an alternative, see FIG. 12, a plurality of eyes 50', 52', 54', and 56' are fixed, as by stitching to the rear tie face 38. A user, if this embodiment is employed, simply engages the hooks 50, 52, 54 and 56 with the correspondingly spaced eyes 50', 52', 54', and 56' of the rear tie face. It will be appreciated that the location of the eyes guide the user to a correct amount of length of the display tail 36; and even if additional eyes are provided, such as 60, 62, 64 and 66, a general guide is provided as to neck size with somewhat more flexibility.

Figure 14:
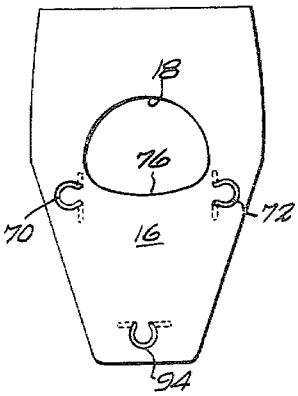
FIG. 14 is an alternative embodiment of the body shown in FIG. 11.
Figure 7:
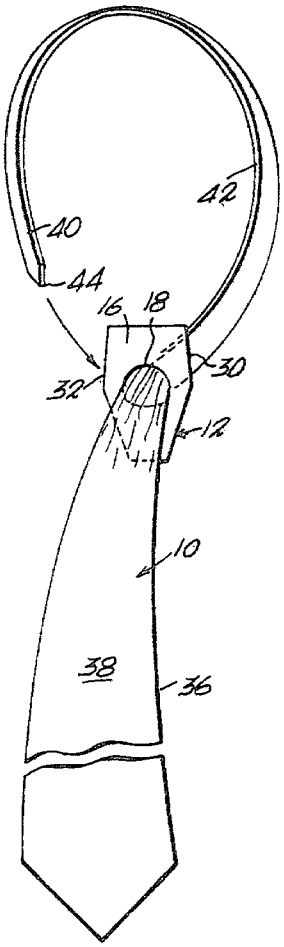
FIGS. 7, 8 and 9 are views illustrating the successive steps of assembly of the necktie length and body.
Figure 8:
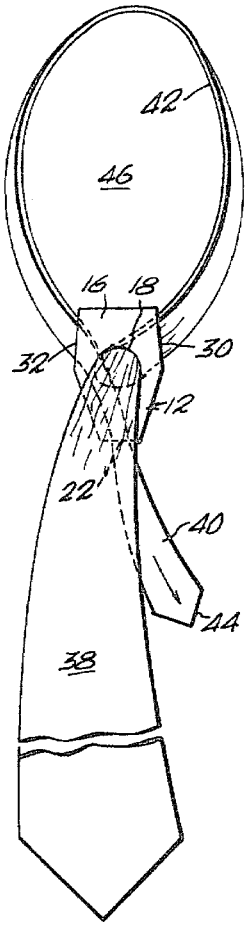
Figure 9:
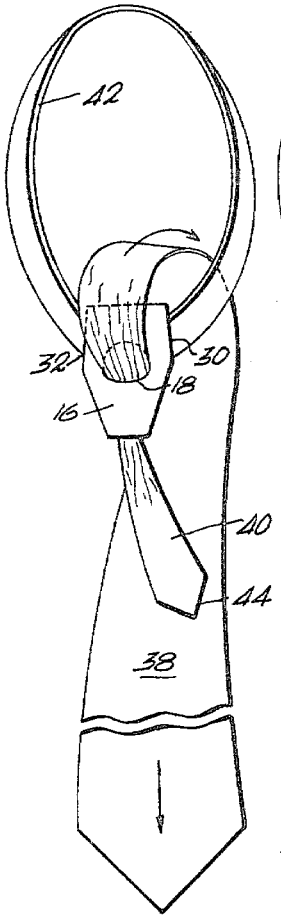

Referring to FIG. 14, the keeper means may be composed of eyes instead of hooks suitably secured to the rear face of the body, see 70 and 72 and hooks, not shown, instead of eyes arranged along the tie replacing the eyes shown in FIG. 12.

Figure 13:
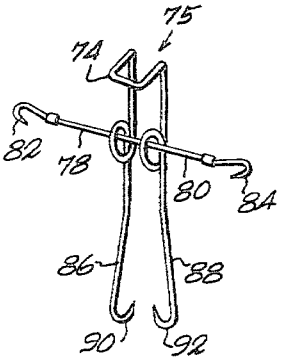
FIG. 13 is an alternative embodiment of a keeper.

In the embodiment of FIG. 13, the keeper means is composed of a clip 75. It has (a) an upper hooked zone 74 to hook over the lower lip 76 of the opening 18 in the rear body face 16; (b) a pair of distally hooked arms 78 and 80 which may be elastic, such as a rubberband length, the hooks being denoted by the numerals 82 and 84; and (c) a pair of downwardly extending, distally hooked legs 86 and 88, in this case the hooks being denoted as 90 and 92. The distal hooks on the arms and legs may be used conveniently as illustrated in FIG. 10 to fix a knot zone of the necktie which is not provided with hooks or eyes to the body. Also a body as in FIG.

14 may be utilized with the distal hooks on the legs extending through a portion of the periphery of the tie and into hooked-up engagement with the eye 94.

Figure 6:
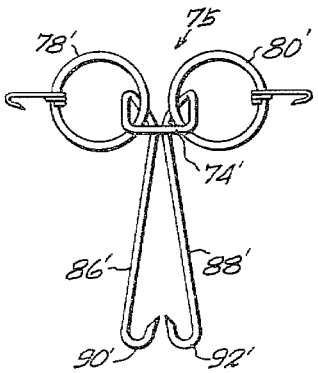
FIG. 6 is a rear elevation view of a keeper described more fully hereinafter.

An alternative clip 75′ is shown in FIGS. 6 and 10. In this embodiment the arms are elastic or stretchable as in the case of the embodiment of FIG. 13, being in the form of small rubberbands 78′ and 80′. This embodiment also features the hooked legs 86′ and 88′, the hooks being denoted 90′ and 92′ on the legs and the upper lip hook 74′.

While the instant invention has been shown and described in what is considered to be a practical and preferred embodiment and sets forth the best mode, it is recognized that departures may be made from the exact description set forth herein within the spirit of the invention which is therefore not to be limited except as set forth in the claims in accordance with the doctrine of equivalents.

What is claimed is:

1. A simulated knotted necktie comprising:

a hollow knot-shaped definng body comprising, a main face, a rear face having a first hole centrally arranged and having a lower lip, a bottom face with a hole, and a top face, and generally upwardly diverging side walls, each having an opening adjacent the juncture of eac side wall and the top fan;

a necktie length comprising, a display tail having a display face and a rear face, a rear tail with a tip end, and a neck loop length between the tails;

said neck loop length extending from said body openings, said rear tail extending from said bottom hole, and said display tail extending from said rear face hole with said rear face of said display tail overlaying said body top face and main face and extending away from said body; and keeper means to hold said display tail in snug jacketing relation of said body main face defining a simulated knot zone at said body.

2. A simulated knotted necktie as set forth in claim 1 wherein the keeper means comprises clip means having a hook to engage the lower lip and means for hooked-up engagement of the display tail and the body.

3. The device as set forth in claim 2 wherein the means for hooked-up engagement comprises a pair of oppositely extending distally hooked arms in hooked-up engagement with the display tail and a pair of distally hooked legs in hooked-up engagement with the display tail.

4. The device as set forth in claim 3 wherein the arms are adjustable in length.

* * * * *